United States Patent [19]

Pernici

[11] 4,446,190

[45] May 1, 1984

[54] CERAMIC TILE WITH ITS REAR CONFIGURED AS UNIFORMLY DISTRIBUTED PROJECTIONS

[75] Inventor: Ermanno Pernici, Reggio Emilia, Italy

[73] Assignee: C.I.E.F. -Compagnia Immobiliare e Finanziaria S.p.A., Modena, Italy

[21] Appl. No.: 470,959

[22] Filed: Mar. 1, 1983

[30] Foreign Application Priority Data

Apr. 2, 1982 [IT] Italy ..... 46819 A/82

[51] Int. Cl.[3] ..... B32B 3/30; B32B 3/26

[52] U.S. Cl. ..... 428/156; 428/174; 428/179; 428/180; 428/212; 428/426

[58] Field of Search ..... 428/179, 174, 156, 180, 428/426, 542.2, 542.8, 212

[56] References Cited

U.S. PATENT DOCUMENTS 3,018,015 1/1962 Agriss et al. ..... 428/179

4,146,666 3/1979 Houtlosser ..... 428/179

*Primary Examiner*—Paul J. Thibodeau

*Attorney, Agent, or Firm*—Birch, Stewart, Kolasch & Birch

[57] ABSTRACT

A ceramic tile has its rear uniformly configured as small frusto-conical or frusto-pyramidal tapered projections 2 of constant height, thus eliminating internal stresses during firing, eliminating zones of different color tone on the front face, and improving the gripping coefficient when laying.

A portion of the projections 2, in groups of at least two, are taller to form feet 3 for resting during stacking.

6 Claims, 2 Drawing Figures

CERAMIC TILE WITH ITS REAR CONFIGURED AS UNIFORMLY DISTRIBUTED PROJECTIONS

The present invention relates to a special configuration of the rear surface of ceramic facing or paving tiles, in particular of the type intended for decoration with polychrome glaze by the known double firing method.

In this method, the support or biscuit is fired in a stacked state, after which it is decorated, glazed and subjected to a second passage through the kiln for firing the glaze.

At the present time, the rear of the tile is provided with a certain number of shaped relief portions, for example twelve shaped portions in a 20×20 centimeter format, which have the double purpose of keeping the tiles spaced apart when they are stacked, and facilitating their gripping when mounted on the respective surface by way of adhesive or cement.

It should be noted that the projections which at present exist on the rear of tiles are constituted by frusto-conical shaped portions having a surface area of about 1 $cm^2$ at their top and 3 $cm^2$ at their base.

This known tile configuration has certain drawbacks which, up to the present time, have not been able to be obviated.

A first drawback is that the presence of the shaped portions induces appearance defects on their exposed or front surface.

These defects arise from the fact that the region occupied by the shaped portion is subjected to greater compression during the tile moulding, and the more highly compacted clay in this region reacts differently to the application of the glaze and any decoration.

The result is that after firing the glaze, on the front of the tile the regions occupied by the shaped portions assume a different tone from that of the surrounding regions, so emphasising the presence of said shaped portions.

A second drawback derives from the fact that the cross-sectional differences due to the presence of the shaped portions negatively affect pile expansion and contraction during firing, which sometimes leads to planarity defects or undesirable internal stress which leads to breakage.

Lastly, modern tile fitting methods favour the use of synthetic adhesives rather than cement or non-cement mortars, and thus the ability of the tile to grip its support surface is of great importance.

In addition, the high cost of adhesives has produced the requirement of considerably reducing the quantities used, and this has resulted in a further structural defect of known tiles, which have a large empty volume between their resting surface on the shaped portions and their rear face, and this volume becomes filled with adhesive.

The invention according to the present application proposes to provide and protect a special rear tile configuration which is able to obviate the aforesaid drawbacks.

According to the present invention, this is attained by providing a tile with a rear surface which comprises a uniform distribution of frusto-conical or square based frusto-pyramidal projections, of which the base has a diameter or side of between 3 mm and 10 mm, the top portion of the projection has a diameter or side of between 3 mm and 7 mm, and the density lies between 0.6 and 1.2 projctions per square centimeter, and preferably 1 projection per square centimeter.

According to the present invention, the height of said projections lies between 0.2 and 1.2 mm, and preferably 1 mm.

Further according to the present invention, a portion of said projections, in groups of at least two adjacent projections, has a greater height of between 1.6 and 2.4 mm, and preferably 2 mm.

These projections of greater height create a small number of resting bases for the tile, each constituted by at least two adjacent projections, the number of these resting bases lying between 2 and 4 for every 100 $cm^2$ of tile.

Further, according to the present invention the projections (2) and (3) have the same size base. A tile with its rear configured in this manner has extremely regular cross-sections, which practically obviates the generation of internal stresses during firing.

Moreover, the rear configuration ensures a coefficient of grip against the laying surface which is comparatively much higher, and an adhesive consumption which is comparatively much lower, than known configurations.

Lastly, a convenient ducting arrangement is created between the stacked tiles to allow uniform hot air circulation in the kiln.

The merits and constructional characteristics of the invention will be apparent from the detailed description of a preferred embodiment thereof given hereinafter by way of non-limiting example with reference to the figures of the accompanying drawings.

Figure 1:
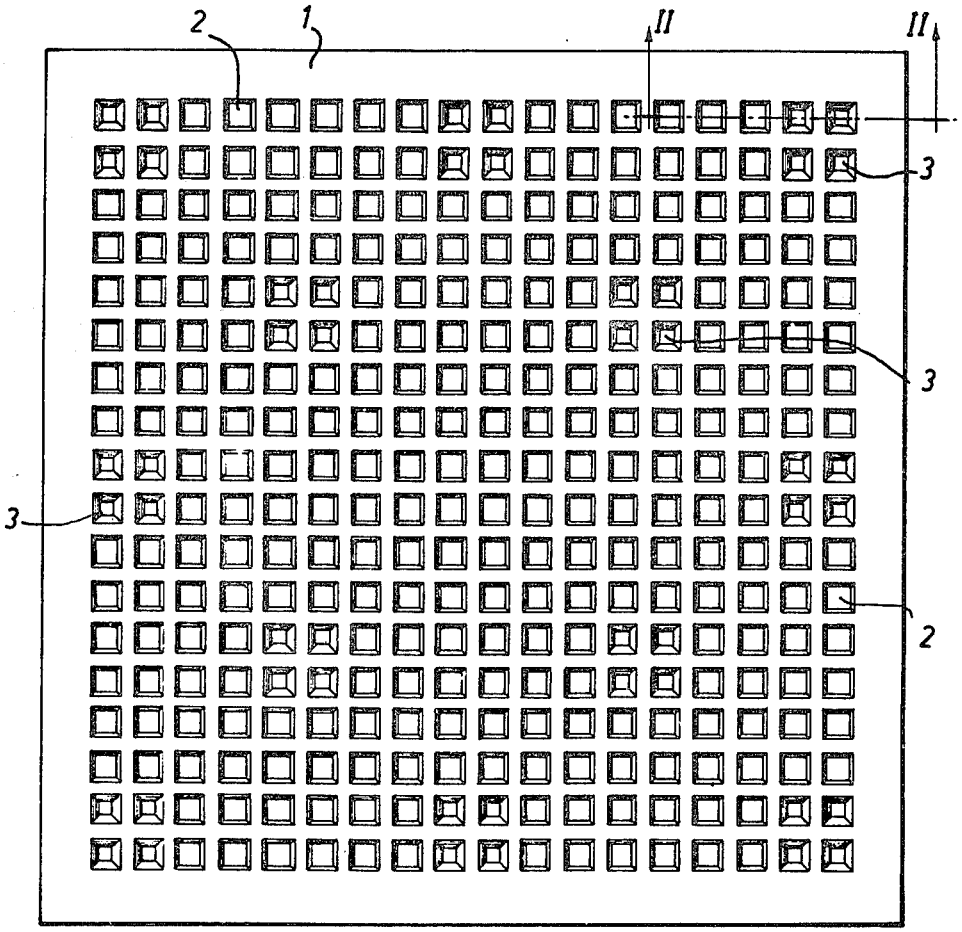
FIG. 1 shows the rear of a tile according to the invention, seen in plan view.
Figure 2:
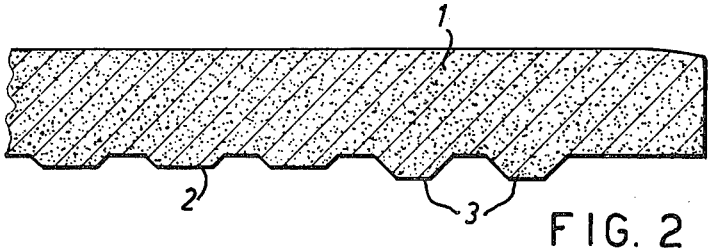
FIG. 2 is a section on the line II—II of FIG. 1.

The figures show a tile 1 having its rear surface provided with uniformly distributed square based frusto-pyramidal projections 2.

Said projections have a major base of side 7 mm and a minor base of side 5 mm, their height being 1 mm.

The density of said projections is 1 projection per square centimeter.

Projections 3, having a height of 2 mm and a minor base correspondingly less than that of the projections 2, the other geometrical characteristics remaining unchanged, are distributed uniformly in groups of adjacent four between the projections 2.

Overall, the projections 3 provide twelve resting feet distributed on the rear of a 20×20 cm tile such as that shown.

The configuration heretofore described enables all the objects of the invention to be attained, as is apparent from the figures alone.

The invention is not limited to the single embodiment heretofore described, and modifications and improvements can be made thereto without leaving the scope of the inventive idea, the basic characteristics of which are summarised in the following claims.

I claim:

1. A ceramic tile having a front surface and a rear surface, said rear surface being uniformly covered with tapered frusto-conical or square based frusto-pyramidal shaped projections (2) of constant height, interspersed with groups of at least two projections (3) of greater height which have the same size base as the projections (2) of constant height and are distributed over the entire rear surface of the tile (1) to constitute resting feet.

2. A tile as claimed in claim 1, characterised in that the bases of the projections (2) of constant height have a surface area of between 25 and 100 $mm^2$.

3. A tile as claimed in claim 1, characterised in that the projections (2) of constant height are distributed with a density of between 0.6 and 1.2 projections per square centimeter.

4. A tile as claimed in claim 1, characterised in that the projections (2) of constant height have a height of between 0.8 and 1.2 mm.

5. A tile as claimed in claim 1, characterised in that the projections (3) of greater height have a height of between 1.6 and 2.4 mm.

6. A tile as claimed in claim 1, characterised in that between two and four groups of projections (3) of greater height are provided for every 100 $cm^2$ of tile (1).

* * * * *